United States Patent [19]

Gurevich et al.

[11] Patent Number: 4,551,867

[45] Date of Patent: Nov. 12, 1985

[54] TOILET BOWL WHICH WASHES

[76] Inventors: Joseph Gurevich; Alex Gurevich, both of 64-40 99 St., Forest Hills, N.Y. 11374

[21] Appl. No.: 549,207

[22] Filed: Nov. 4, 1983

[51] Int. Cl.[4] ..... A47K 4/00; A47K 3/20

[52] U.S. Cl. ..... 4/420.4; 4/420.5; 4/443; 4/444

[58] Field of Search ..... 4/420.1–420.5, 4/446, 447, 448

[56] References Cited

U.S. PATENT DOCUMENTS

| | | | |
|---|---|---|---|
| 1,014,787 | 1/1912 | Torossian | 4/420.5 |
| 1,091,499 | 3/1914 | Friedman | 4/420.5 |
| 1,855,008 | 4/1932 | Calleio | 4/420.5 |
| 2,520,946 | 9/1950 | Martin | 4/446 |
| 2,957,180 | 10/1960 | McMullen | 4/420.2 |
| 3,015,826 | 1/1962 | Aranas | 4/420.4 |
| 3,605,124 | 9/1971 | Marcard et al. | 4/420.2 |
| 3,995,326 | 12/1976 | Umann | 4/420.1 |
| 4,041,553 | 8/1977 | Sussman | 4/447 |

*Primary Examiner*—Henry K. Artis
*Attorney, Agent, or Firm*—Ilya Zborovsky

[57] ABSTRACT

A toilet bowl unit has a bowl arranged to be used a toilet bowl and bounding an interior, and a water supply element located in the interior of the bowl in its front region and arranged to wash the lower parts of the user's body.

14 Claims, 8 Drawing Figures

TOILET BOWL WHICH WASHES

FIELD OF INVENTION

This invention relates generally to a bowl with attachments for washing lower parts of the body, feet, and administering an anema. The construction of the bowl is modified to make it convenient to use and to insure that the bowl always stays cleans automatically.

DESCRIPTION OF THE PRIOR ART

For sanitary cleansing of the lower parts of the body the apparatus called "bidet" is used, and, even though, the apparatus meets the expectations put upon it, bidet requires additional space and expenses. There are combinations of bowl and bidet on the market now, however, the structures are too complex and, therefore, require considerable time and effort to assemble and use. Consequently, the functions such as, device to administer enemas and personal hygiene in home use do not exist, as a permanent attachments.

OBJECTS

Bathrooms in United States are not designed for installation of bidet in addition to the toilet bowl; therefore, even if someone is willing to spend a great deal of money to have the apparatus installed the space shortage in the bathroom will not permit that installation in most cases.

The proposed invention of the toilet bowl which washes, successfully solves this and other problems, since it is a toilet bowl and bidet in one. The combination which can save money and valuable space in the bathroom. To additional advantages of the invention belongs the option of using the apparatus for personal hygiene without the necessity to fully undress. Further objects or advantages of the invention will become apparent from consideration of the drawings and ensuing description thereof.

BRIEF DESCRIPTION OF THE DRAWINGS

For fuller understanding of the nature and objects of the invention, reference should be made to the following detailed description, taken in conection with the accompanying drawing, in which.

Similar reference numerals refer to the similar elements in the drawing.

DESCRIPTION OF PREFERRED EMBODIMENTS

Figure 1:
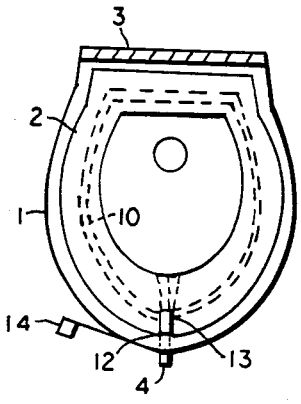
FIG. 1 is a top view.
Figure 3:
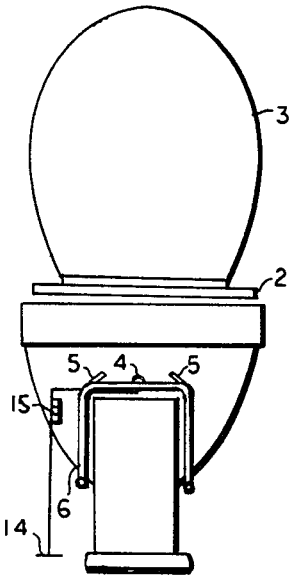
FIG. 3 is a front view.

A bowl unit in accordance with the present invention has a bowl which is identified with reference numeral 1. The bowl 1 has a rim which is considerably wider than the remaining portion of the bowl and than the rims of the existing bowls. The rim is provided with a slant or bevel as identified by 10. The bowl also has a deep concave bottom 11 which is deeper than the bottoms of the existing bowls.

A seat cover 2 with an opening in its central part is pivotable so as to be located on the bowl during use and withdrawn from the bowl during non-use. A closing seat cover 3 closes and open the bowl 1. A water dispensing pipe 4 is located in the front region of the bowl 1 and in the interior of the same. It is provided with cold and hot water regulators which are identified with reference numeral 5. Metal pipes 6 which supply cold and hot water from the source of the same extend from the rear region of the bowl 1 to its front region and are connected there with the dispensing pipe 4. An ending pipe 7 connects the pipes 6 to a plumbing system. The pipes 6 are attached to the bowl by a fastening device 8.

The bowl is provided with a plastic screen for washing of feet as identified by 9. It is removable, and when in use is supported on the rim of the bowl and on a water dispensing pipe 4 as will be described in detail later herein. The water outlet element can be formed as a nozzle 13. A hinge 12 is threadingly connected with the water dispensing pipe 4, and the nozzle 13 is threadingly connected with the hinge 12. The nozzle 13 and the hinge 12 are located in the front region of the bowl 1 inside the latter. A flow control foot pedal 14 is also arranged in the front region of the bowl 1. It is fixable in three positions by a three level bolt 15.

OPERATION

The use of the suggested apparatus as a toilet bowl presents no question and it is used as any conventional bowl, we all so familiar with. However, the seat cover in front is somewhat widened and does not reach the out-side rim of the bowl, which is specifically designed for washing the lower parts of the body.

Furthermore, when used as a cleansing apparatus, the seat cover (2) comes up to a vertical position. Thereafter, a person seats on the rim of the bowl (1) where rim is angeled as shown in (10)—which permits a person sit on rim as if on the regular bidet.

The design and the size of the apparatus permits the person to sit with the back resting on the seat covers (2,3). In this position it is easy to turn the knobs (5) which regulate the supply of the cold and hot water, until the desirable temperature is reached, through the pipe (4) which has threading for attachment of the shower screen, extention pipe (with interchangeable heads), rubber hose, and also hinge (12) for regulating the direction of the water spurt. It is also possible to operate the apparatus in question, by the flow control pedal (14) provided that the water temperature is preadjusted to a desirable level.

Figure 2:
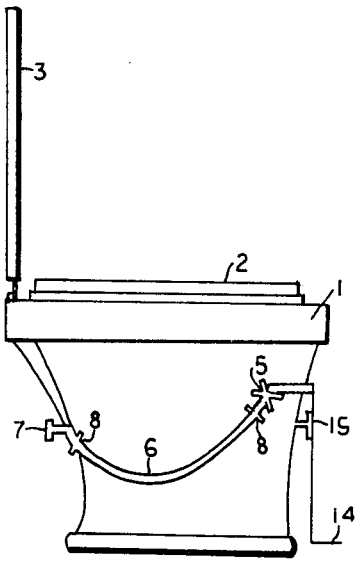
FIG. 2 is a side view.
Figure 5:
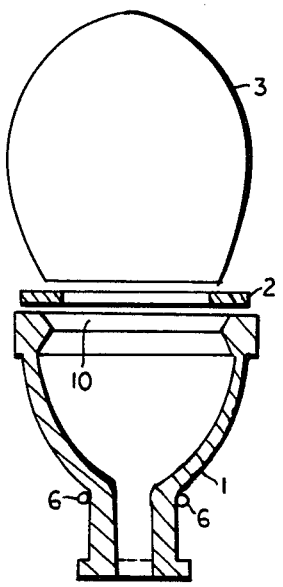
FIG. 5 is a horizontal cross section.
Figure 4:
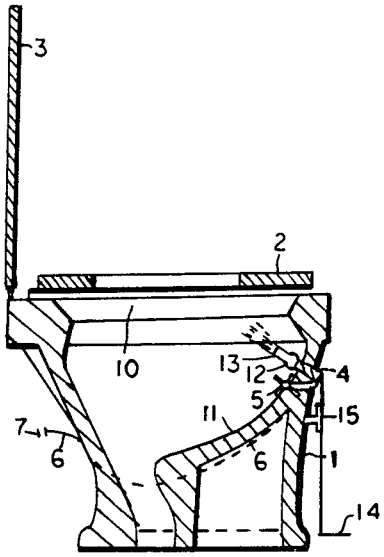
FIG. 4 is a vertical cross section of the side panel.
Figure 7:
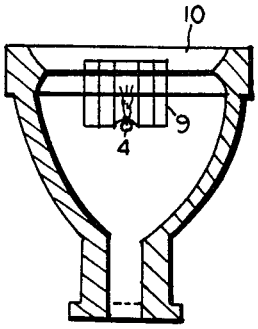
FIG. 7 is a perspective view of the screen.
Figure 8:
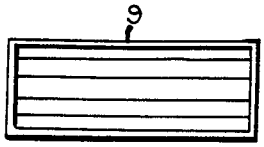
FIG. 8 is a model of the screen.

Furthermore, when the apparatus used to wash feet, or person simply, does not wish to keep his or her foot on the pedal, the bolt (15) could be used, as shown in FIG. 2, and the device will operate automatically at the pre-set water pressure and temperature.

Cleansing of the lower parts of the body is done with use of hands. To insure that the apparatus always stays clean, the bottom (11) of the bowl is situated below the water supplying pipe (4) which is deeper than in the standard bowls. The depth in the combination with the design of the bowl insures that unit cleans itself every time it is used as a bidet.

Figure 6:
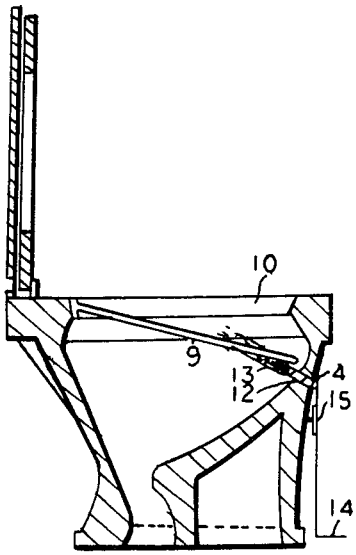
FIG. 6 is a screen, side view.

In addition to the above uses of the apparatus the design permits washing of the feet as shown in FIG. 6, 7, 8. with the use of portable plastic or light metal screen (9). The screen (9) lies on water pipe (4) with one side and on the rim of the bowl with other sides.

While the above description contains many specificities, these should not be construed as a limitations on the scope of the invention, but rather as an exemplification of one preferred embodiment thereof. Many other variations are possible. Accordingly, the scope of the invention should be determined not by the embodiment illustrated, but the appended claims and their legal equivalents.

Now that the invention has been described, that which is claimed is:

1. A toilet bowl unit, comprising a bowl bounding an interior and having a main part with front and rear parts and an upper rim with an upper bowl opening;

a cover having a cover opening and turnable relative to said bowl between an extended position in which it rests on said rim of said bowl and a retracted position in which it is withdrawn from said rim of said bowl;

water supplying means extending into said interior of said bowl and having a water outlet element arranged in said interior;

said cover opening having a relatively small length in a horizontal plane so as to insure comfortable sitting of a user on said cover in its extended position for defecation and/or urination, without excessive sinking of the lower parts of the user's body into said bowl, said rim of said bowl being considerably wider than said main part and having an inner surface provided with a bevel to insure comfortable sitting of the user directly on said rim in the retracted position of said cover, for washing the lower parts of the user's body, said bowl opening being considerably longer in the horizontal plane that said cover opening so that when the user sits directly on said rim for washing a sufficient space remains in said front part of said bowl for introducing the user's hand through said bowl opening into the interior of said bowl in said front part to reach by the user's hand the lower parts of the body and said water outlet element, said water supplying means having said water outlet element hingedly arranged in said front part of said bowl so as to issue water onto the lower parts of the user's body and also to enable the user to change the direction of a water stream issuing from said water outlet element so as to direct the water stream onto and successively wash the respective lower parts; and a foot pedal located outside of said bowl in the region of said front part so as to be reachable by a user's foot while sitting on said rim and arranged to adjust under the action of the user's foot the quantity of water issuing from said water outlet element onto the lower parts of the user's body.

2. A toilet bowl unit as defined in claim 1, wherein said water supplying means includes a water outlet element located in said interior of said bowl, and two pipes connected with said water outlet element and arranged to supply cold water and warm water, respectively, to said water outlet element.

3. A toilet bowl unit as defined in claim 2, and further comprising two manual water quantity regulating members arranged to regulate the quantity of cold and warm water supplied to said water outlet element and to thereby adjust the temperature of water exiting the latter.

4. A toilet bowl unit as defined in claim 3, wherein, said regulating members being located in the region of said front part of said bowl so as to allow the user sitting on said bowl to actuate said regulating members.

5. A toilet bowl unit as defined in claim 4; and further comprising a water dispensing pipe extending between said two pipes and provided with said water outlet element, said water quantity regulating members being arranged on said water dispensing pipe.

6. A toilet bowl unit as defined in claim 2; and further comprising a water dispensing pipe communicating with said two pipes and connected with said water outlet element.

7. A toilet bowl unit as defined in claim 6, wherein said dispensing pipe is provided with a hingedly mounting said outlet element.

8. A toilet bowl unit as defined in claim 7, wherein said hinge has two threaded ends and is screwable by its one end with said dispensing pipe and with its other end with said water outlet element.

9. A toilet bowl unit as defined in claim 7, wherein said water outlet element is formed as a nozzle screwable into said other end of said hinge.

10. A toilet bowl unit as defined in claim 7, wherein said water outlet element is formed as a shower head screwable into said other end of said hinge.

11. A toilet bowl unit as defined in claim 7, wherein said water outlet element is formed as a rubber hose provided with interchangeable adapters for enemas and personal hygiene and screwable into said other end of said hinge.

12. A toilet bowl unit as defined in claim 2, wherein said pipes extend from the region of said rear part of said bowl to the region of said front part of said bowl and are connected with said water outlet element in the region of said front part.

13. A toilet bowl unit as defined in claim 1, and further comprising an automatic bolt presettable at three levels and arranged to hold said pedal at said levels so as to adjust the quantity of water exiting said water outlet element.

14. A toilet bowl unit as defined in claim 12, and further comprising a removable screen insertable into said interior of said bowl above said water outlet element to support the user's foot during washing the latter, said screen being supported in said interior on said dispensing pipe and on a rim of said bowl.

* * * * *